United States Patent [19]

Brockhaus

[11] Patent Number: 4,800,623

[45] Date of Patent: Jan. 31, 1989

[54] AUTOMOTIVE DOOR HINGE ASSEMBLY WITH REMOVABLE HINGE WING

[75] Inventor: Ernst Brockhaus, Remscheid-Hasten, Fed. Rep. of Germany

[73] Assignee: Ed. Scharwächter GmbH & Co. KG, Fed. Rep. of Germany

[21] Appl. No.: 913,626

[22] Filed: Sep. 30, 1986

Related U.S. Application Data

[63] Continuation of Ser. No. 656,518, Oct. 1, 1984, abandoned.

[30] Foreign Application Priority Data

Oct. 10, 1983 [DE] Fed. Rep. of Germany ..... 3336802
Feb. 13, 1984 [DE] Fed. Rep. of Germany ..... 3405083

[51] Int. Cl.[4] ..... E05D 7/10

[52] U.S. Cl. ..... 16/254; 16/262; 16/386

[58] Field of Search ..... 16/254, 260–266, 16/380, 381, 386, 273, 342

[56] References Cited

U.S. PATENT DOCUMENTS

| | | | |
|---|---|---|---|
| 1,920,466 | 8/1933 | Haskins et al. | 16/386 |
| 3,395,423 | 8/1968 | Bus | 16/262 |
| 3,431,591 | 3/1969 | Betso | 16/265 |
| 4,137,603 | 2/1979 | Kvasnes | 16/381 |
| 4,237,577 | 12/1980 | Chapel | 16/262 |
| 4,501,045 | 2/1985 | Boyer | 16/376 |
| 4,528,718 | 7/1985 | Brockhaus | 16/273 |

FOREIGN PATENT DOCUMENTS

| | | | |
|---|---|---|---|
| 939751 | 10/1963 | United Kingdom | 16/273 |
| 2106587 | 4/1983 | United Kingdom | 16/386 |

*Primary Examiner*—Frank T. Yost
*Assistant Examiner*—James L. Wolfe
*Attorney, Agent, or Firm*—Toren, McGeady & Associates

[57] ABSTRACT

In a hinge assembly intended for suspension of motor vehicle doors having two hinge halves which can be attached at one of two door installation parts and connected with one another so as to be rotatable by means of a hinge pin, the hinge halves being rotatable with running fit in one hinge half and being arranged secured against axial movement, the two hinge halves are arranged in a position which corresponds to the hung-in position of the vehicle door and they are secured by screw bolts which penetrate the hinge eye of the second hinge half to prevent that the hinge falls apart during a possible automatic loosening from the position of the two hinge halves when the door is hung in due to assembly errors. Screw bolts form the primary safety mechanism of the hinge assembly and a secondary emergency safety device is also provided which is formed by means of interlocking sections or parts of both hinge wings extending over the area of the operating angle of traverse of the hinge assembly.

12 Claims, 4 Drawing Sheets

AUTOMOTIVE DOOR HINGE ASSEMBLY WITH REMOVABLE HINGE WING

This is a continuation of application Ser. No. 656,518, filed Oct. 1, 1984 now abandoned.

The present invention relates generally to door hinge assemblies and more specifically to a door hinge assembly having a removable hinge wing and which is particularly suitable for mounting motor vehicle doors.

Devices of the type to which the present invention relates generally comprise a first hinge half provided with a hinge eye and a second hinge half which is also provided with a hinge eye. Furthermore, such devices include a hinge pin which is secured against axial movement in the hinge eye of the first hinge half, but is supported by means of a bearing bushing with a running fit and engages by means of a radially cantilevering collar between the facing surfaces of the hinge eye of both hinge halves, the second hinge half being connected with the hinge pin against an axially directed relative motion by means of a positive interlocking connection, for example, a clamping or press fit connection or by a connection formed, for example, by means of a screw bolt or a threaded nut which can be screwed in place or by a wedge connection.

In modern automotive manufacturing, removable hinge wings of hinge types of the kind mentioned above are used more and more frequently in order to fit and adjust, on the one hand, doors which are already attached to the car shell and, on the other hand, to facilitate and accelerate the assembly of the interior finishing operation of the vehicle by enabling the doors of the vehicle which are already mounted thereon to be removed as late as the beginning of the finishing process. The doors must be again hung in after completion of the installation of the interior equipment into the vehicle shell.

A particular problem which arises with regard to removable hinges consists in the need for securing the mutual positioning of the two hinge halves in the hung-in vehicle door, because an automatic loosening of the safety means of the connection between one hinge half and the hinge pin may cause the vehicle door to fall out and consequently cause serious accidents.

The present invention is directed toward providing a door hinge assembly for motor vehicle doors which, on the one hand, can be manufactured with limited effort of continuous hinge sections and whose two hinge halves are easily combined when the vehicle door is hung in and are then absolutely secured against an automatic complete separation and, in which, in addition, the assembly advantages of a clamping connection or an interlocking connection between a hinge pin and the second hinge half are maintained.

SUMMARY OF THE INVENTION

Briefly, the present invention may be defined as a removable door hinge assembly particularly for motor vehicle doors comprising: a first hinge half adapted to be attached to one part of the door installation and including a first hinge eye; a second hinge half adapted to be attached to a complementary part of said door installation and including a second hinge eye; a hinge pin operatively engaged within said first and second hinge eyes and secured against axial movement relative thereto, interconnecting said hinge halves for pivotal movement through an operating angle of traverse, said hinge pin being connected so as to be secured against rotation relative to one of said hinge eyes; bushing means made of bearing material supporting said hinge pin over a part of its length in the other of said hinge eyes, maintenance free, with a running fit; and projections formed in one of said hinge halves and recesses formed in the other of said hinge halves, said recesses and projections being limited in the circumferential direction and arranged alternately so as to engage into one another over a predetermined area of said operating angle of traverse of said hinge assembly; said hinge pin being formed with a smooth, cylindrical, circumferential surface over at least a substantial part of the length thereof engaged within said one hinge eye.

In accordance with the features of the invention, there is provided a hinge assembly wherein, on the one hand, the section of the hinge pin which engages into the hinge eye of the removable hinge half has a smooth, cylindrical, circumferential surface with the exception of a short beveled or rounded off end area or of a possible recess directed transversely to its axis, and that, on the other hand, the two hinge halves are secured in addition to the safety mechanism by means of a locking connection of the second hinge half with the hinge pin, also against axially directed relative movement between the hinge pin and the second hinge half beyond the area of the operating angle of traverse of the hinge by means of recesses and projections which are arranged at both hinge halves alternately and are directed radially to the hinge axis.

The connection between the hinge pin and the second hinge half, which holds the hinge in its normal operating position when the vehicle door is hung in, is secured under assembly and operating conditions by connecting means which act in an interlocking manner between the second hinge half and the hinge pin. This connection undertakes the additional use of a safety device which is constructed as a bayonet and consists of projections and recesses which are arranged alternately on both hinge halves. This safety device is only an emergency safety means to protect the vehicle door from falling out when the standard interlocking safety means should have loosened for any reason, for example, as a result of assembly operations contrary to appropriate procedures after repair of the vehicle.

The present invention may be practically realized in different embodiments.

In a first practical embodiment, a hinge pin is rotatably supported in the first hinge half by means of a bearing bushing of maintenance free bearing material and it is immovably affixed in the axial direction, with the hinge pin being secured against movement in the axial direction on the one hand by means of a safety disk which lies on the lower end face of the hinge eye of the first hinge half and, on the other hand, by means of a radially cantilevering collar which lies on the upper end face of the hinge eye of the first hinge half. By means of the section thereof projecting beyond the hinge eye of the first hinge half, the hinge pin engages through the hinge eye of the second removable hinge half which is braced in the axial direction with the hinge pin by means of a threaded nut which can be screwed onto its upper end which is provided with a thread and which consequently is secured against separation of the hinge in the axial direction. In order to prevent separation of the hinge during loosening of the threaded nut, a mutual bayonet lock is provided which is effective over the area of the operating angle of traverse of the hinge and which has a radially directed extension, which, if necessary, is formed as a special molded part onto the hinge eye of the second hinge half, and a correspondingly shaped recess in the hinge section head or blade area which is U-shaped viewed from the top and which acts in its design as an emergency security device.

In a second practical embodiment of the invention, the hinge pin is supported and fixed in the first hinge half in the same manner as in the first practical embodiment previously described, and the hinge pin engages by means of an additional section into the bore of a hinge eye of the second hinge half wherein, in this area, the hinge pin is connected with interlocking means in the circumferential direction with the hinge eye of the second hinge half for which either a milled knob or a conical tooth construction, or both, are available and for which to the hinge pin, but also a transverse pin which is inserted transversely to the hinge axis into the hinge eye, for example, a screw bolt or the like, and at least touches the hinge pin and engages into a corresponding circumferential groove of the hinge pin, may be provided. If, for the mutual connection and securing of the connection of the hinge eye and the hinge pin, a transverse pin is provided which penetrates or engages within a transverse bore in the hinge eye of the second hinge half and engages into a radially directed, partially circular recess of the hinge pin which is in its assembly position fixed on the one side by a head and on the other side by a splint, then as emergency locking means, a bayonet lock of the two hinge halves, effective over the area of the operating angle of traverse of the hinge, is provided. Accordingly, the two hinge halves are made of continuous hinge sections and are provided in the top area alternately with projections and recesses which form a bayonet lock of the two hinge halves at least over the area of the operating angle of traverse of the hinge.

In another practical embodiment of the invention, the hinge pin is again supported and fixed in the hinge eye of the first hinge half, as is the case with the first embodiment previously described. The hinge pin engages in the hinge eye of the second hinge half over only a part of its height with radial play. To secure the second hinge half in its position which corresponds to the hung-in position of the hinge, a screw bolt is provided which engages with a threaded portion into a blind bore in the hinge pin and rests with its head on the outer end face of the hinge eye of the second hinge half. In this manner, the hinge eye of the second hinge half is braced against the radially cantilevering collar of the hinge pin. As an emergency safety measure against automatic separation of the two hinge halves, a bayonet lock is provided which is formed by recesses which are arranged alternately in the head areas of the hinge section of both hinge wings and arranged symmetrically along the height of the hinge eye of the first hinge half.

In a removable door hinge for motor vehicle doors, it is also provided to simplify manufacturing of the door hinge and the bayonet lock of the two hinge halves in that both hinge halves consist of portions of hinge sections and in that, in the area of the head portion of the hinge section, recesses are provided which are arranged alternately at the same distance from the upper or lower edge of the respective hinge half and are directed transversely to the section axis of the head portion of the hinge section. This has the advantage that the means for mutual locking of the two hinge halves over the area of the operating angle of traverse of the door hinge may be accomplished by simply cutting the area free of the continuous hinge section. At the hinge sections which form the two hinge halves, bead or strip projections are arranged which are directed radially to the hinge axis and of which one forms an opening end stop for the door hinge and the other a part of the bayonet lock of the two hinge halves. The bead projection at the top portion of the hinge section which forms the other hinge half and which forms a part of the bayonet lock, and the strip projection at the hinge section which forms a hinge half and serves as an opening end stop, are always left or cut off over equally large vertical sections of the entire height of the hinge. Additionally, the hinge section which forms a removable hinge half is cut away in its head portion from the bottom of its radially directed recess up to the bottom edge of the hinge half by a partial amount.

The practical embodiments disclosed above are also representative of a category of embodiments. The invention, therefore, also comprises the combination of differently created interlocking connections of the hinge eye of the second hinge half with the hinge pin with differently constructed and arranged emergency locking means for both hinge halves. In particular, the emergency lock may also be a part which engages over the hinge eye of the second removable hinge half over the area of the operating angle of traverse of the hinge, for example, a projection at the first hinge half or a part to be especially connected with the latter.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there are illustrated and described preferred embodiments of the invention.

DETAILED DESCRIPTION OF THE PREFERRED EMBODIMENTS

Figure 1:
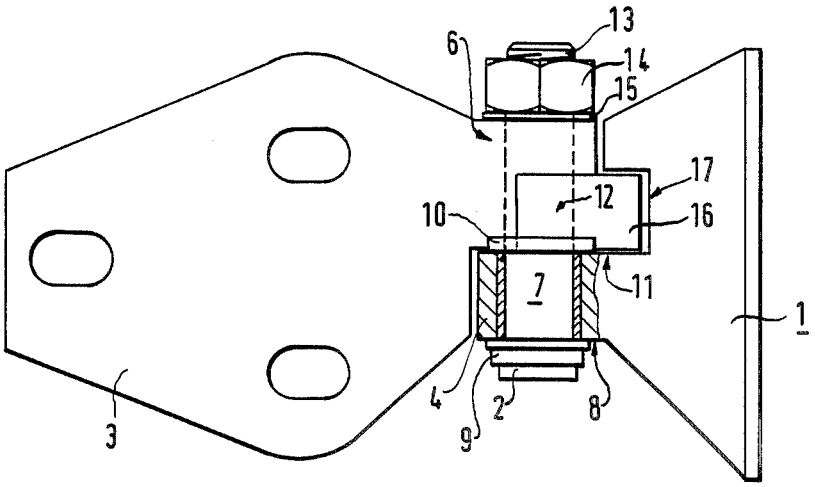
FIG. 1 is a side view partially in section showing a separable hinge assembly which is provided with an axially acting connection of the second hinge half with the hinge pin, as well as with an emergency securing element.
Figure 2:
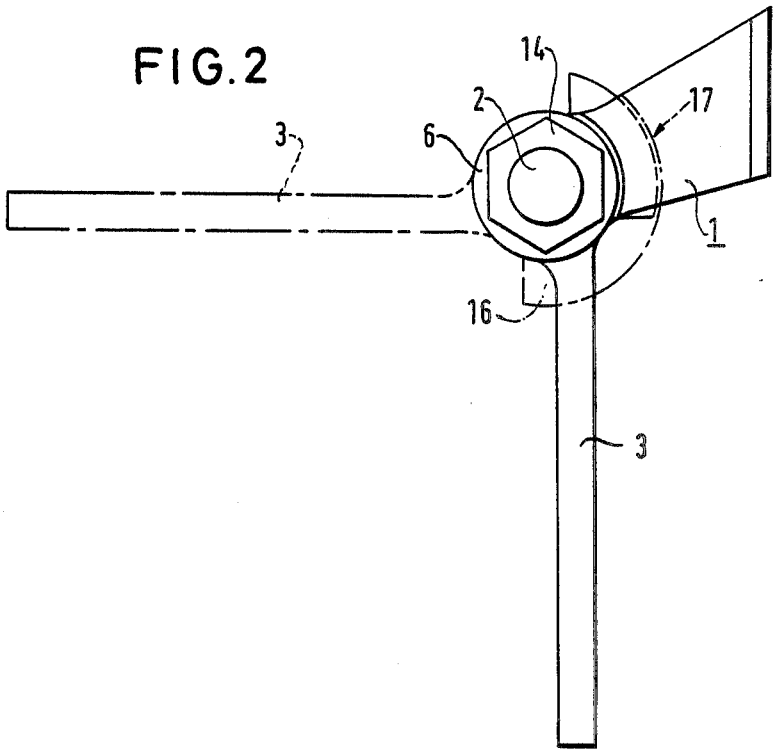
FIG. 2 is a top view of of FIG. 1.

Referring now to the drawings wherein the various embodiments of the invention are shown, with similar parts being identified with like reference numerals, and referring more particularly to FIGS. 1 and 2, a removable door hinge assembly in accordance with the present invention is depicted as comprising a first hinge half 1 which may be attached to a door installation part (not shown) and a second hinge half 3 which is pivotally connected by means of a hinge pin 2 with the first hinge half. The second hinge half 3 may be attached to another door installation part (also not shown) and the hinge pin 2 engages through a hinge eye 4 of the hinge half 1 and a hinge eye 6 of the second hinge half 3. The hinge pin 2 is rotatably supported by means of a bushing of bearing material at a cylindrical section 7 thereof in the hinge eye 4 of the first hinge half 1 and it is fixed against movement in the axial direction by means of a safety element 9 which is supported at the lower outer surface 8 of the hinge eye 4. In the reverse direction, the hinge pin 2 is also secured against movement in the axial direction by means of a radially directed disk 10 which rests on the end face 11 of the hinge eye 4.

The hinge pin 2 is provided with a smooth, cylindrical, circumferential surface 12 over its longitudinal portion which engages into the hinge eye 6. After the smooth, cylindrical, circumferential surface 12 of the upper hinge pin section, there follows an end area which is provided with a screw thread 13 onto which there is screwed a nut 14. The nut 14 may have a lining ring 15 cooperative therewith and the nut 14 operates to brace the second hinge half 3 against the collar 10 of the hinge pin 2 and, thus, to secure the mutual position of the two hinge halves 1 and 3 in the installed hinge. In the event of failure of this axially directed interlocking safety element, the hinge is additionally provided with an emergency locking element which is structured in the manner of a bayonet lock and which is effective over its area of the operating angle of traverse. This emergency lock consists, in the embodiment shown in FIGS. 1 and 2, of an extension 16 which projects radially beyond the hinge eye 6 of the second hinge half 3, and which, as viewed in the top view of FIG. 2, is formed with an approximately segment shaped configuration and may be formed either by cutting free an area of a continuous hinge section provided with a bead projection or which may be a separate part placed on the hinge eye 6 and a recess 17 in the top area of the hinge wing section of the first hinge half 1 which recess is U-shaped in side view.

Figure 3:
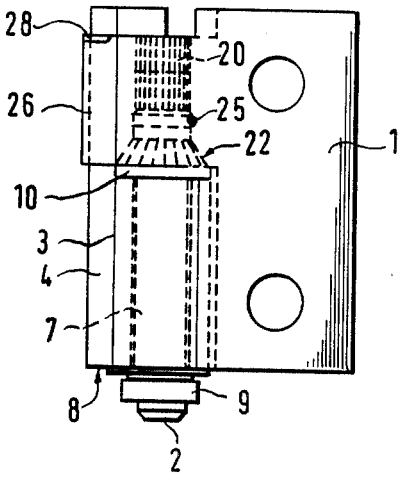
FIG. 3 is a side view showing a separable hinge assembly with a radially acting connection between the hinge eye of the second hinge half and the hinge pin, as well as an emergency securing element.
Figure 4:
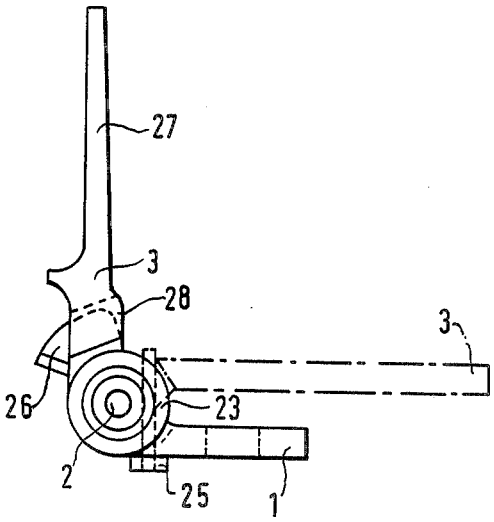
FIG. 4 is a top view of FIG. 3.
Figure 5:
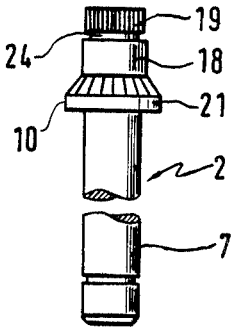
FIG. 5 is a detailed representation of the hinge pin for the assembly according to FIGS. 3 and 4.

A further embodiment of the present invention is shown in FIGS. 3, 4 and 5, wherein the hinge pin 2 is supported in the hinge eye 4 of the first hinge half 1 in the same manner as in the embodiment described in FIGS. 1 and 2. At the upper section 18 of the pin 2, best seen in FIG. 5, which upper section 18 engages into the hinge eye 6 of the second hinge half 3, the hinge pin 2 is formed with a circumferential border 19 which effects an interlocking connection with the hinge eye 6 of the hinge half 3, the hinge eye 6 having a corresponding complementary profiling or shaping 20. It will be seen that the section 19 and the section 20 may be formed as knurled sections.

Instead of, or in addition to, the border or section 19, the hinge pin 2 may be formed at its upper portion with a sloped, toothed construction 21 which is arranged in the embodiment shown in FIG. 5 adjacent a radially extending flange or collar 10 of the hinge pin 2, but which may also be arranged in the front area of the hinge pin 2. A corresponding, complementary construction 22 adapted to cooperate with the wedged, toothed construction 21, is formed in the hinge eye 6 of the second hinge half 3. In the axial direction, the connection between the hinge pin 2 and the hinge eye 6 is created by means of a screw 25 which penetrates a transverse bore 23 in the hinge eye 6 of the second hinge half 3 and which engages into a circumferential groove 24 of the hinge pin 2.

An emergency interlocking of the two hinge halves 1 and 3 which prevents the hinge assembly from falling apart when the screw 25 is loosened consists, in the embodiment of FIGS. 3–5, of an extension 26 in the head area of the hinge section of the first hinge half 1, which extension 26 projects radially beyond the hinge eye 6 of the second hinge half 3 and which is approximately segment shaped, as seen in top view, and of a recess 28 in the second hinge half 3 which is directed toward the hinge blade 27 and which is arranged in the area of the top hinge eye 6, is associated with the second removable hinge half 3.

Figure 6:
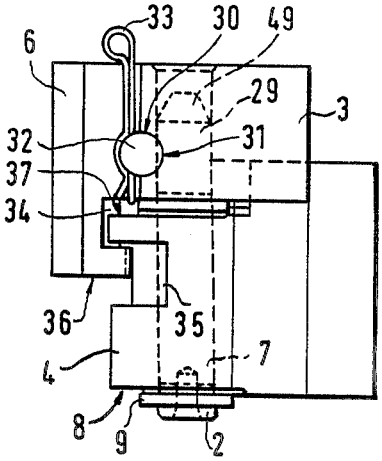
FIG. 6 is a side view of another separable hinge assembly provided with a radially acting connection between the hinge eye of the second hinge half and the hinge pin, as well as with an emergency safety element.
Figure 7:
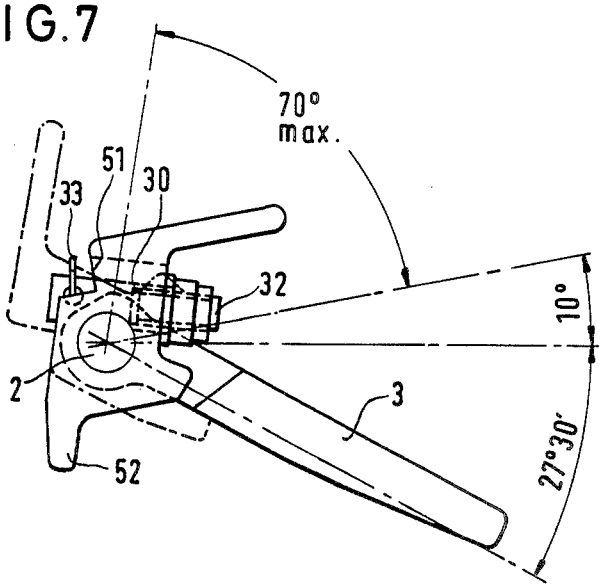
FIG. 7 is a top view of FIG. 6.
Figure 9:
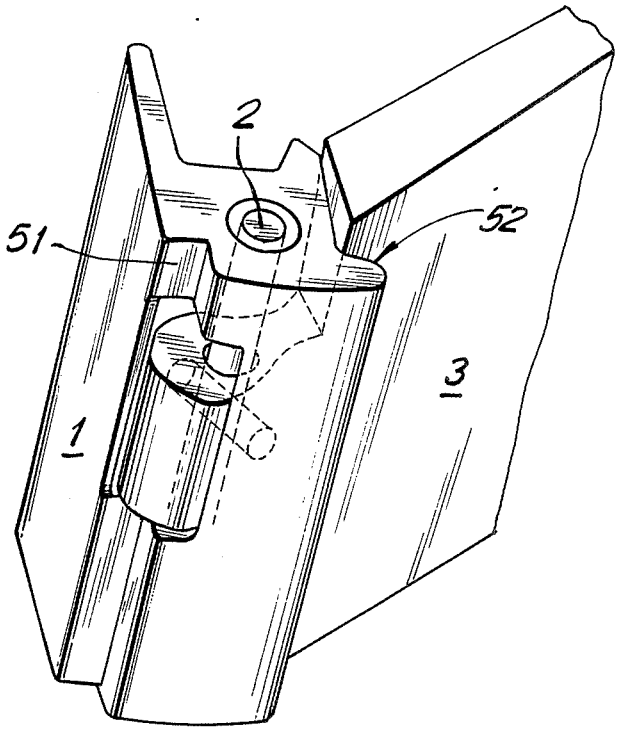
FIG. 9 is a perspective view of the hinge assembly of FIG. 6.

In the embodiment according to FIGS. 6, 7 and 9, the hinge pin 2 is provided over its longitudinal portion which engages into the hinge eye 6 with a smooth, cylindrical, circumferential surface 12. Following the smooth, cylindrical, circumferential surface 12 of the upper section 29 of the hinge pin 2, there is provided a rounded off head area 49 which serves to facilitate threading of the hinge pin 2 into the hinge eye 6 of the hinge half 3. The hinge eye 6 also has a smooth, cylindrical, inner circumferential surface. The nonrotative connection of the hinge half 3 with the hinge pin 2 is effected, in the embodiment of FIGS. 6, 7 and 9, by means of a bracing pin 32 which engages into a circumferential recess 31 formed in the hinge pin 2. However, the nonrotative interconnection between the hinge half 3 and the hinge pin 2 may be achieved in any desired or suitable manner other than that shown.

The two hinge halves 1 and 3 are formed by cutting a continuous hinge section and they are provided for forming a mutual bayonet lock over an area of the operating angle of traverse of the hinge alternately with recesses 34 and 35 which are directed radially with respect to the head portion of the respective hinge section. The recess 34 shown in FIG. 6 in the removable upper hinge half 3 is formed an equal distance from the lower edge 36 of the hinge half 3 as is the recess 35 in the other hinge half from the upper edge 37 of the hinge eye 4. The hinge section which forms the other hinge half 1 is provided with a beaded projection 51 which is radially directed relative to the hinge axis, while the hinge section which forms the removable hinge half 3 is provided at its top portion with a strip projection 52. The strip projection 52 as best shown in FIGS. 7 and 9, forms thereat an opening end stop for the door hinge and is left over a certain partial amount of the height of the hinge eye 5, but otherwise, is cut off from the head portion of the hinge section for the hinge half 3. Conversely, the beaded projection 51 of he hinge section which forms the other hinge half 1 and also forms a part of the mutual bayonet lock of the two hinge halves is cut off by an amount which corresponds to the height of the remaining section of the strip projection 52 of the hinge section of the removable hinge half. This results in a corresponding enlargement in the height of the recess 35. Additionally, the hinge section which forms the one removable hinge half 3 is cut free by a partial amount in its head portion from the bottom of its radially directed recess 35 up to the lower edge 36 of the hinge half 3.

Figure 8:
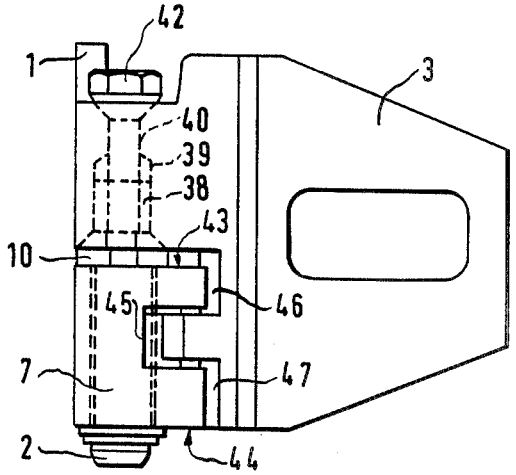
FIG. 8 is a side view of a separable hinge assembly provided with an axially acting connection of the second hinge half with the hinge pin, as well as with an emergency safety device.

In the embodiment shown in FIG. 8, the hinge pin 2 which is supported and fixed in the hinge eye 4 of the first hinge half 1, in the manner described, is provided with a short shaft portion 39 which engages with radial play in a hinge eye bore 38 of the hinge eye 6 of the second hinge half 3. In this embodiment, the hinge eye 6 of the second hinge half 3 is connected with the hinge pin 2 by means of a screw bolt 42 which engages into an axial bore 40 of the hinge pin 2. The screw bolt 42 presses the hinge eye 6 against the radially cantilevering collar 10 of the hinge pin 2. The emergency interlocking of the two separable hinge halves 1 and 3, over the angular area of the operating angle of traverse of the hinge, is, in the embodiment of FIG. 8, symmetrical to the height of the hinge eye 4 of the first hinge half 1 and consists of a recess 45 which is arranged at the same distance from the upper end face 43 and the lower end face 44 of the hinge eye 4 in the head area of the hinge section of the first hinge half 1, as well as two recesses 46 and 47 which are arranged in the head area of the hinge section of the second hinge half 3, of which the one recess 46 is open toward the plane of separation of the hinge and the other recess 47 is open toward the underside of the hinge.

As will be evident particularly from the side views of the individual embodiments described in the foregoing, the interlocking bayonet connection of the two hinge halves 1 and 3 operates only as an emergency interlock and, therefore, mutual contact of the parts of the bayonet interlocking mechanism in a hinge assembly which is in the normal operating position may be omitted so that narrow tolerances and special surface qualities are not required. The parts of the bayonet lock may engage into one another with very little play.

Thus, in accordance with the foregoing, it will be seen that the present invention provides a removable wing hinge assembly intended for the suspension of motor vehicle doors having two hinge halves which can be attached always at one of the door installation parts and which can have a hinge eye and are connected with one another so as to be rotatable by means of a hinge pin. The pin being rotatable with a running fit in one hinge half and being, however, arranged secured against axial movement. In the assembly of the invention, the two hinge halves in their position which corresponds to the hung-in vehicle door are secured by means of screw bolts which penetrate the hinge eye of the second removable hinge half to prevent the hinge assembly from falling apart during a possible automatic loosening from the position in which the two hinge halves are when the door is hung in, due to assembly errors, and the invention provides that, in addition to the screw bolts which form the primary safety means, there is also provided a secondary emergency safety means which is formed by the interlocking engagement of the sections or parts of both of the hinge wings or halves over the angular area of the operating angle of traverse of the hinge.

While specific embodiments of the invention have been shown and described in detail to illustrate the application of the inventive principles, it will be understood that the invention may be embodied otherwise without departing from such principles.

What is claimed is:

1. A removable door hinge assembly particularly for motor vehicle doors comprising:

a first hinge half adapted to be attached to one part of a door installation and including a first hinge eye;

a second hinge half adapted to be attached to a complementary part of said door installation and including a second hinge eye;

a hinge pin operatively engaged within said first and second hinge eyes interconnecting said hinge halves for pivotal movement about a hinge axis through an operating pivoting angle of said hinge assembly, said hinge pin being secured against axial movement is said first hinge eye of said first hinge half but supported therein with a running fit in bushing means made of maintenance free bearing material and engaging by means of a radially protruding collar between opposing joint faces of said first and second hinge eyes;

said hinge pin being also mounted in said second hinge eye of said second hinge half in such a way that said second hinge half may be pulled from engagement with said hinge pin in the axial direction thereof;

radially oriented positively interlocking means connecting said second hinge half with said hinge pin so as to be nonrotatable with respect thereto; and first and second safety means which are installed independently of each other and which act independently of each other securing said second hinge half against unintended unhinging with respect to said hinge pin and with respect to said first hinge half;

said first safety means comprising means detachably interposed between said second hinge half and said hinge pin to prevent undesired axial disengagement therebetween and to allow such axial disengagement upon detachment thereof;

said second safety means comprising means interposed between said second hinge half and said first hinge half to prevent relative axial disengagement therebetween over only said operating pivoting angle of said hinge assembly.

2. An assembly according to claim 1, wherein said first safety means comprise frictional engaging connection means.

3. An assembly according to claim 1, wherein said first safety means comprise a press-fitted connection.

4. An assembly according to claim 1, wherein said first safety means comprise threaded nut and bolt means.

5. An assembly according to claim 1, wherein said first safety means comprise a key connection.

6. An assembly according to claim 1, wherein said first safety means comprise a recess in said second hinge eye extending transversely to its axis which operates to rotatively affix said hinge pin to said second hinge eye along a portion of the length thereof engaged within an upper and lower end of said second hinge eye and wherein said second hinge eye of said second hinge half is connected with said hinge pin by means of radially directed screw bolt, with said second safety means being formed by alternate recesses arranged in the area of the hinge sections of said first and second hinge halves wherein said recesses are arranged symmetrically taken relative to the height of said first hinge eye of said first hinge half.

7. An assembly according to claim 1, wherein said second safety means comprise a radial extension extending from said second hinge half within a recess within said first hinge half over an angular distance equivalent to said pivoting angle of said hinge assembly.

8. An assembly according to claim 1, wherein said first safety means is a nut threaded upon said hinge pin.

9. An assembly according to claim 1, wherein said first safety means is a threaded bolt threaded into said hinge pin.

10. An assembly according to claim 1, wherein said first safety means comprises threaded bolts oriented radially with respect to said hinge pin.

11. An assembly according to claim 1, wherein said first safety means comprises threaded bolts oriented tangentially with respect to said hinge pin.

12. An assembly according to claim 1, wherein said first safety means comprises pins oriented tangentially with respect to said hinge pin.

* * * * *